US010734730B2

(12) United States Patent
Wu et al.

(10) Patent No.: US 10,734,730 B2
(45) Date of Patent: Aug. 4, 2020

(54) NARROW BAND SLOT ANTENNA WITH COUPLING SUPPRESSION

(71) Applicant: BEIHANG UNIVERSITY, Beijing (CN)

(72) Inventors: Qi Wu, Beijing (CN); Donglin Su, Beijing (CN)

(73) Assignee: BEIHANG UNIVERSITY, Beijing (CN)

( * ) Notice: Subject to any disclaimer, the term of this patent is extended or adjusted under 35 U.S.C. 154(b) by 0 days.

(21) Appl. No.: 16/076,305

(22) PCT Filed: Jun. 26, 2017

(86) PCT No.: PCT/CN2017/000405
§ 371 (c)(1),
(2) Date: Aug. 7, 2018

(87) PCT Pub. No.: WO2018/000803
PCT Pub. Date: Jan. 4, 2018

(65) Prior Publication Data

US 2019/0044242 A1 Feb. 7, 2019

(30) Foreign Application Priority Data

Jun. 27, 2016 (CN) ..... 2016 1 0479348

(51) Int. Cl.

| | |
|---|---|
| ***H01Q 13/10*** | (2006.01) |
| ***H01Q 21/28*** | (2006.01) |
| ***H01Q 1/38*** | (2006.01) |
| ***H01Q 1/52*** | (2006.01) |

(52) U.S. Cl.
CPC ..... *H01Q 13/103* (2013.01); *H01Q 1/38* (2013.01); *H01Q 1/521* (2013.01); *H01Q 21/28* (2013.01)

(58) Field of Classification Search
CPC ..... H01Q 1/38; H01Q 1/521; H01Q 1/525; H01Q 1/528; H01Q 13/10; H01Q 13/103; H01Q 13/106; H01Q 9/16
See application file for complete search history.

(56) References Cited

U.S. PATENT DOCUMENTS

| | | | | |
|---|---|---|---|---|
| 4,733,245 | A * | 3/1988 | Mussler | H01Q 19/09 343/769 |
| 2005/0162328 | A1* | 7/2005 | Mori | H01Q 3/44 343/770 |
| 2006/0125703 | A1* | 6/2006 | Ma | H01Q 13/103 343/767 |
| 2009/0021439 | A1* | 1/2009 | Kanno | H01Q 3/247 343/767 |

OTHER PUBLICATIONS

Peiyu Liang, Qi Wu, "Duality principle of characteristic modes for the analysis and design of aperture antennas," IEEE Transactions on Antennas and Propagation, vol. 66, No. 6, pp. 2807-2817, Jun. 2018.

* cited by examiner

*Primary Examiner* — Robert Karacsony

(57) ABSTRACT

The present invention discloses a narrow band slot antenna with a coupling suppression. The slot antenna includes a medium plate (1), a copper-clad layer (2), an A-capacitor (3), and a B-capacitor (4). The copper-clad layer (2) has an A-slot (21) and a B-slot (22) thereon, the A-capacitor (3) and the B-capacitor (4) are respectively mounted inside and at two ends of the B-slot (22). The present invention loads the capacitors at a specific position on a finite medium plate to increase the isolation between the antennas, which is beneficial to rectify the slot antenna.

3 Claims, 4 Drawing Sheets

NARROW BAND SLOT ANTENNA WITH COUPLING SUPPRESSION

CROSS REFERENCE OF RELATED APPLICATION

This is a U.S. National Stage under 35 U.S.C 371 of the International Application PCT/CN2017/000405, filed Jun. 26, 2017, which claims priority under 35 U.S.C. 119(a-d) to CN 201610479348.2, filed Jun. 27, 2016.

BACKGROUND OF THE PRESENT INVENTION

Field of Invention

The present invention relates to a slot antenna, and more particularly to a narrow band slot antenna with a coupling suppression.

Description of Related Arts

With the continuous advancement and development of radar systems and wireless communication devices, the gap technology has been more and more widely applied to the design of slot antennas. Due to significant advantages such as high aperture efficiency, low power loss, large power capacity, compact structure, and convenient processing and installation, the waveguide slot array antenna disposed on the waveguide wall has become a preferred form of current radar antennas. On the other hand, due to advantages of miniaturization and low cost, the planar printed slot antennas with multi-band and dual-polarization characteristics are widely used in mobile terminal equipment and wireless base stations. In addition, in antenna designs of various industries, it can be found that when the operating frequencies of the antennas are not overlapped with each other, the strong out-of-band coupling between the antennas cannot be ignored.

SUMMARY OF THE PRESENT INVENTION

In order to suppress the out-of-band coupling between narrow-band antennas on a finite medium plate, the present invention designs a narrow band slot antenna with a coupling suppression. The present invention loads capacitors at specific positions of a copper-clad layer on a finite medium plate to increase the isolation between the antennas.

The present invention designs a capacitor-loaded slot antenna with coupling suppression, so as to solve the technical problem that how to suppress the out-of-band coupling between narrowband antennas on the finite medium plate; the present invention adopts the technical solution that a copper-clad layer with slots is disposed on a medium plate through copper cladding process, two capacitors are disposed in one slot of the copper-clad layer with slots, and a feed point is located at a midpoint of the two slots.

The narrow band slot antenna with a coupling suppression provided by the present invention comprises a medium plate, a copper-clad layer, an A-capacitor and a B-capacitor, wherein the copper-clad layer has an A-slot and a B-slot thereon, the A-capacitor and the B-capacitor are respectively mounted inside and at two ends of the B-slot. A thickness of the copper-clad layer is in a range of 0.018 mm-0.035 mm. In the present invention, a size of the slot antenna is constrained in accordance with a condition that a wavelength $\lambda$ of the slot antenna is in a range of 50 mm to 5000 mm.

Advantages of the slot antenna provided by the present invention are as follows.

(1) The present invention utilizes a medium plate to simulate a finite ground plane, and when the size of the medium plate is fixed, the loaded capacitors can be used to further enhance the isolation between the antennas.

(2) The slot antenna provided by the present invention is simple to manufacture, the operating frequency of the antenna can be changed by adjusting the size of the antenna, so that the application of the antenna is wider.

(3) The slot antenna provided by the present invention has many characteristics such as low profile, light weight, simple processing, easy conformity with objects, mass production, diversification of electrical properties, broad band and integration with active devices and circuits, and is suitable for large-scale production. It can simplify the production and debugging of the whole machine, thus greatly reducing the cost.

(4) Through slots on a conventional antenna and capacitors in the slots, the conventional antenna is easy to be rectified for improving the isolation between the antennas.

Figure 1:
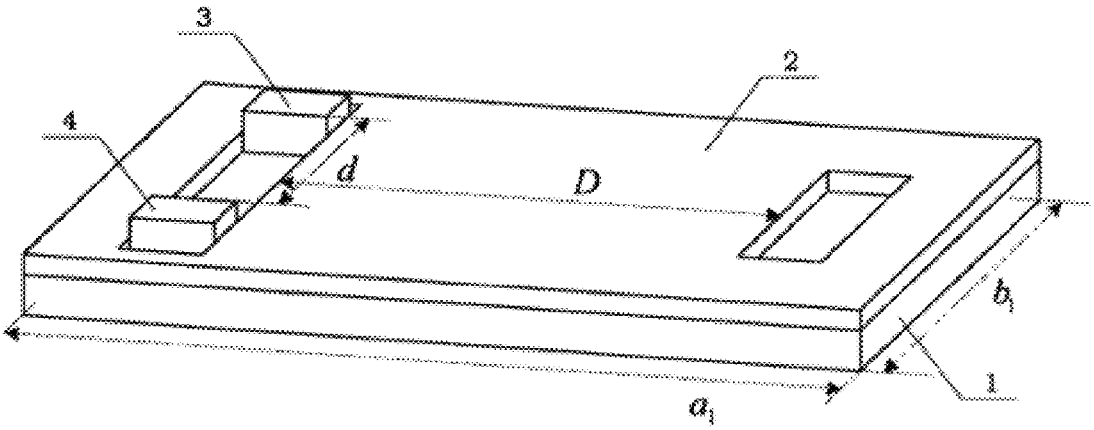
FIG. 1 is a structurally schematic view of a slot antenna with loaded capacitors provided by the present invention.
Figure 2:
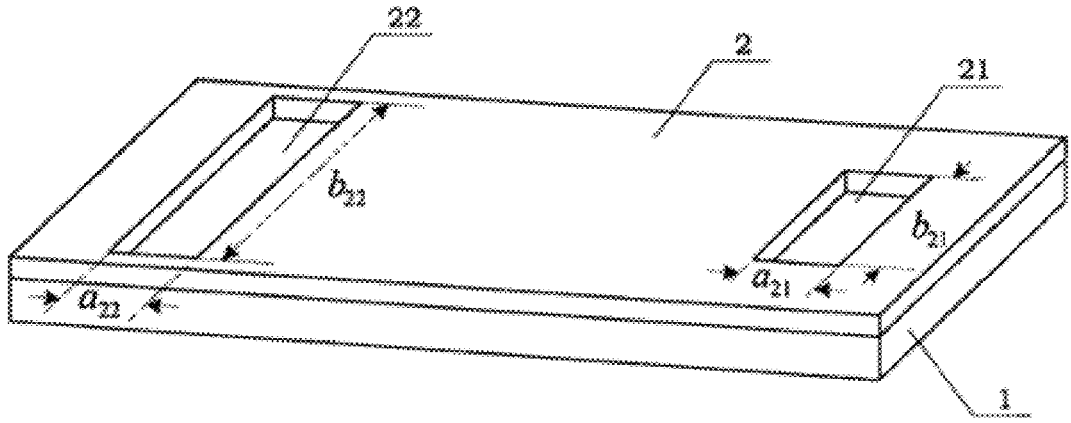
FIG. 2 is a structurally schematic view of the slot antenna without the loaded capacitors provided by the present invention.

In the drawings, 1: medium plate; 2: copper-clad layer; 21: A-slot; 22: B-slot; 3: A-capacitor; 4: B-capacitor.

DETAILED DESCRIPTION OF THE PREFERRED EMBODIMENT

The present is further explained with accompanying drawings and embodiments as follows.

As shown in FIG. 1, the present invention provides a narrow band slot antenna with a coupling suppression, which comprises a medium plate 1, a copper-clad layer 2, an A-capacitor 3, and a B-capacitor 4, wherein the copper-clad layer 2 has an A-slot 21 and a B-slot 22 thereon, the A-capacitor 3 and the B-capacitor 4 are respectively mounted inside and at two ends of the B-slot 22.

In the present invention, a thickness of the copper-clad layer 2 is in a range of 0.018 mm-0.035 mm.

A length of the medium plate 1 is denoted as $a_1$, a width thereof is denoted as $b_1$, and a thickness thereof is generally in a range of 0.5 mm-1.5 mm.

A length of the A-slot 21 is denoted as $a_{21}$, and a width thereof is denoted as $b_{21}$.

A length of the B-slot 22 is denoted as $a_{22}$, and a width thereof is denoted as $b_{22}$.

A distance between the A-slot 21 and the B-slot 22 is denoted as D.

A distance between the A-capacitor 3 and the B-capacitor 4 is denoted as d.

The slot antenna provided by the present invention is fed through a center feed method, i.e., is fed at a midpoint of the A-slot 21 and a midpoint of the B-slot 22, respectively.

In the present invention, both the A-capacitor 3 and the B-capacitor 4 are high-frequency high-Q GJM series capacitors manufactured by Japanese Murata Corp. with a capacitance in a range of 0.2 pF-20 pF.

In the present invention, taking into account an actual application scenario of the slot antenna, a size of the slot antenna is constrained in accordance with a condition that a wavelength λ, of the slot antenna is in a range of 50 mm to 5000 mm, wherein:

$$a_1=(0.8-1.5)\lambda, b_1=(0.6-1.0)\lambda;$$

$$d=0.76\ b_{22};$$

$$D=(0.3-0.5)\lambda;$$

$$a_{21}=(0.005-0.01)\lambda, b_{21}=(0.2-0.3)\lambda;$$

$$a_{22}=(0.005-0.01)\lambda, b_{22}=(0.4-0.6)\lambda.$$

First Embodiment

A length $a_1$ of the medium plate 1 is 175 cm, a width $b_1$ thereof is 110 cm, and a thickness thereof is generally 0.8 mm. A thickness of the copper-clad layer 2 is 0.035 mm.

A length $a_{21}$ of the A-slot 21 is 1 cm, and a width $b_{21}$ thereof is 43.9 cm.

A length $a_{22}$ of the B-slot 22 is 1 cm, and a width $b_{22}$ thereof is 89 cm.

A distance D between the A-slot 21 and the B-slot 22 is 75 cm.

A distance d between the A-capacitor 3 and the B-capacitor 4 is 68 cm. A capacitance of the A-capacitor 3 is 4.6 pF. A capacitance of the B-capacitor 4 is 4.6 pF.

The performance of the slot antenna according to the first embodiment of the present invention is evaluated through S-parameters. In the drawings, the dotted line represents the conventional antenna (i.e., no capacitor is loaded), and the solid line represents the slot antenna according to the first embodiment of the present invention.

Figure 3A:
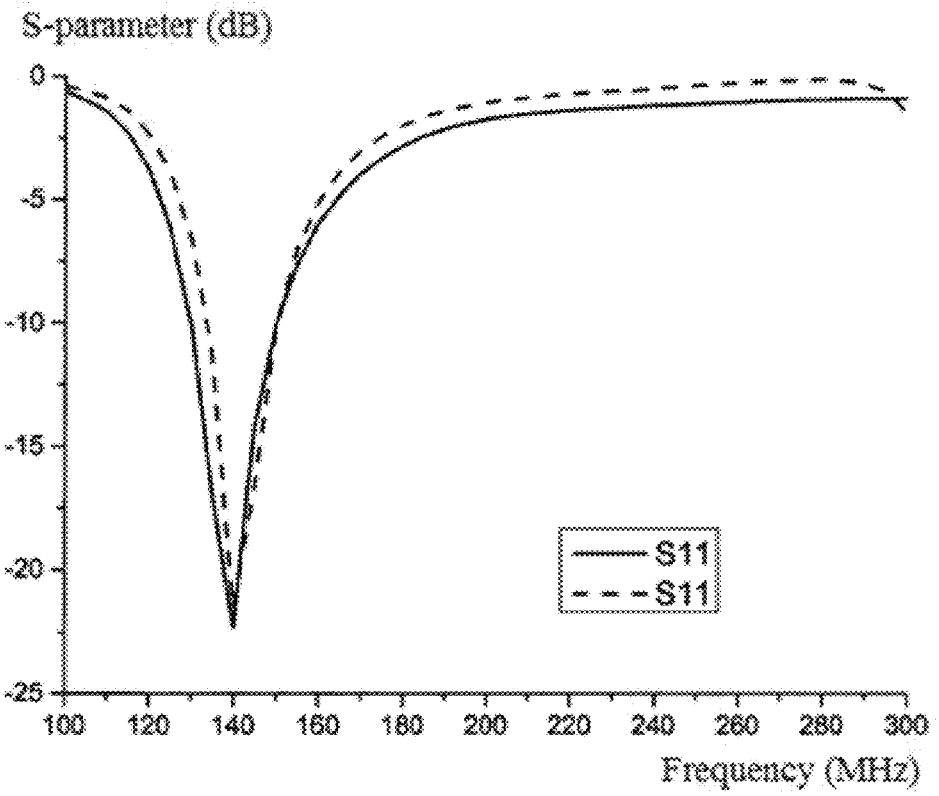
FIG. 3A is an S11 parameter diagram of a slot antenna according to a first embodiment of the present invention.

Referring to FIG. 3A, the S11 parameter represents the working performance of the B-slot, which is basically unchanged at an operating frequency of 140 MHz before and after the capacitors are loaded.

Figure 3B:
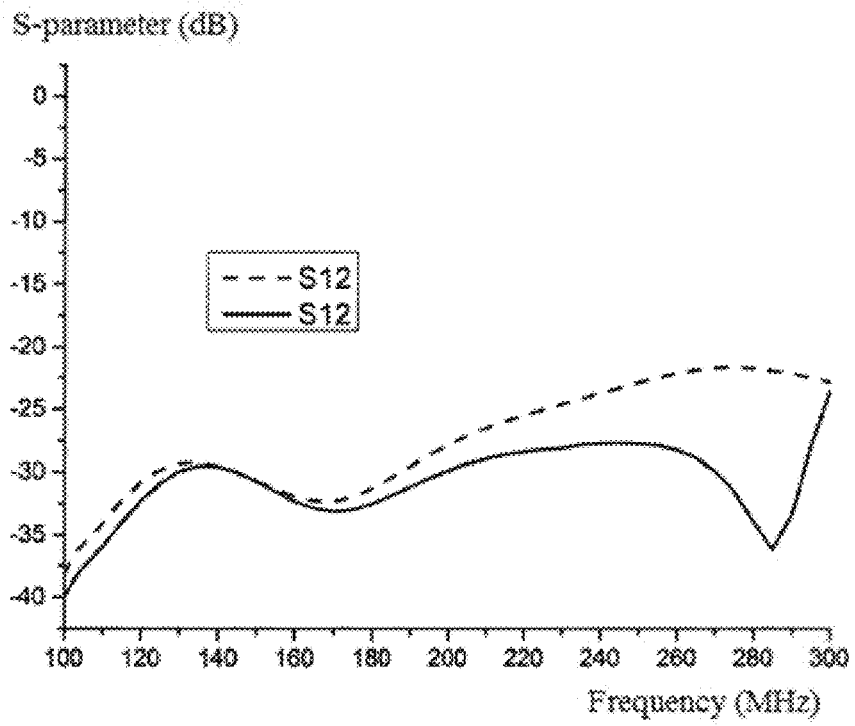
FIG. 3B is an S12 parameter diagram of the slot antenna according to the first embodiment of the present invention.
Figure 3C:
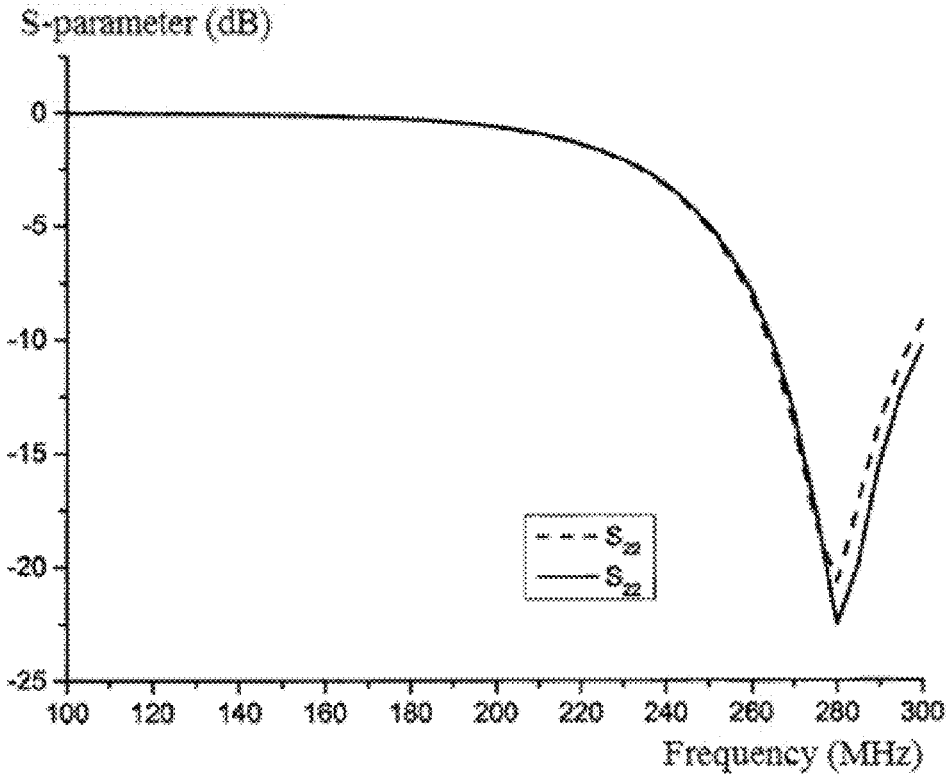
FIG. 3C is an S22 parameter diagram of the slot antenna according to the first embodiment of the present invention.

Referring to FIG. 3B, the present invention uses the S12 parameter to evaluate the isolation between the A-slot and the B-slot before and after the capacitors are loaded. As shown in FIG. 3B, the coupling degree of the conventional antenna at the operating frequency of 140 MHz is −22 dB, and however, the coupling degree of the slot antenna according to the first embodiment of the present invention is reduced to −34 dB, which is decreased by 12 dB compared with the conventional antenna. Referring to FIG. 3C, the S22 parameter represents the working performance of the B-slot, which is basically unchanged at an operating frequency of 280 MHz before and after the capacitors are loaded.

Figure 4A:
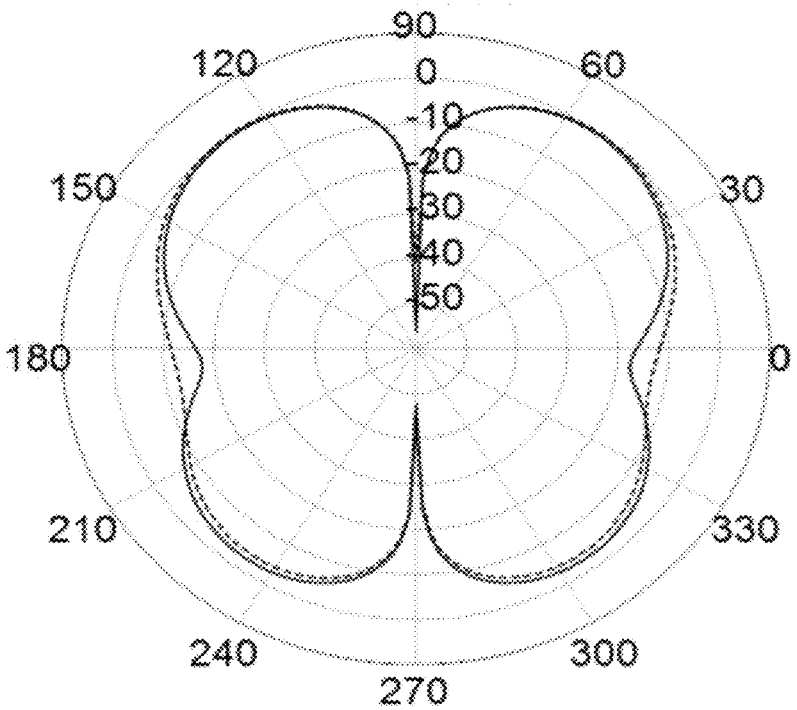
FIG. 4A is an E-plane directional diagram of the slot antenna according to the first embodiment of the present invention, in which a solid line denotes an original state orientation diagram, and a dashed line denotes an optimized state diagram.
Figure 4B:
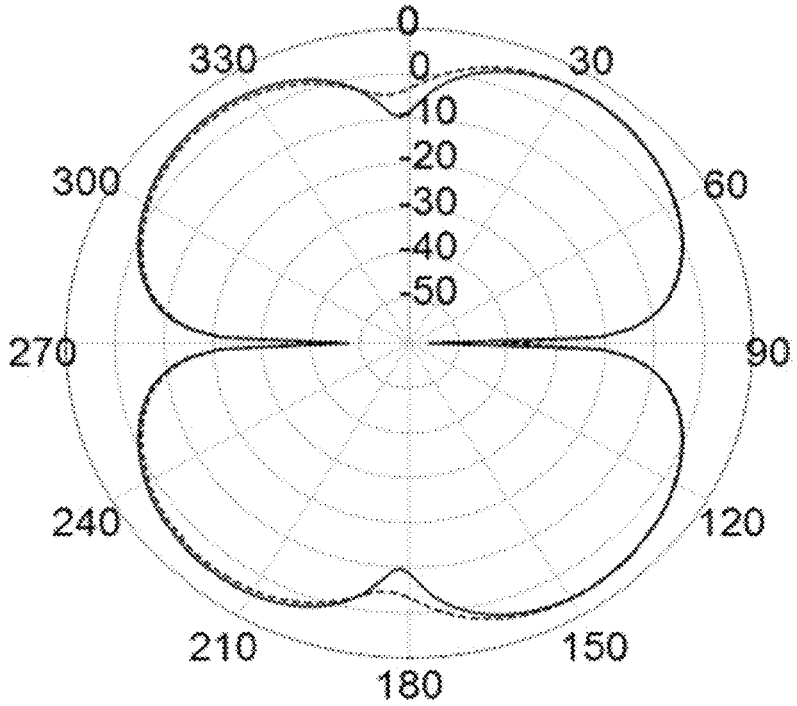
FIG. 4B is an H-plane directional diagram of the slot antenna according to the first embodiment of the present invention, in which a solid line denotes an original state orientation diagram, and a dashed line denotes an optimized state diagram.

The performance of the slot antenna according to the first embodiment before and after the capacitors are loaded is evaluated through a directional diagram. In the drawings, the dotted line represents the conventional antenna, and the solid line represents the slot antenna according to the first embodiment of the present invention. It can be seen from the E-plane directional diagram of FIG. 4A and the H-plane directional diagram of FIG. 4B that the radiation performance of the slot antenna is not affected when the operating frequency is 140 MHz.

Figure 5:
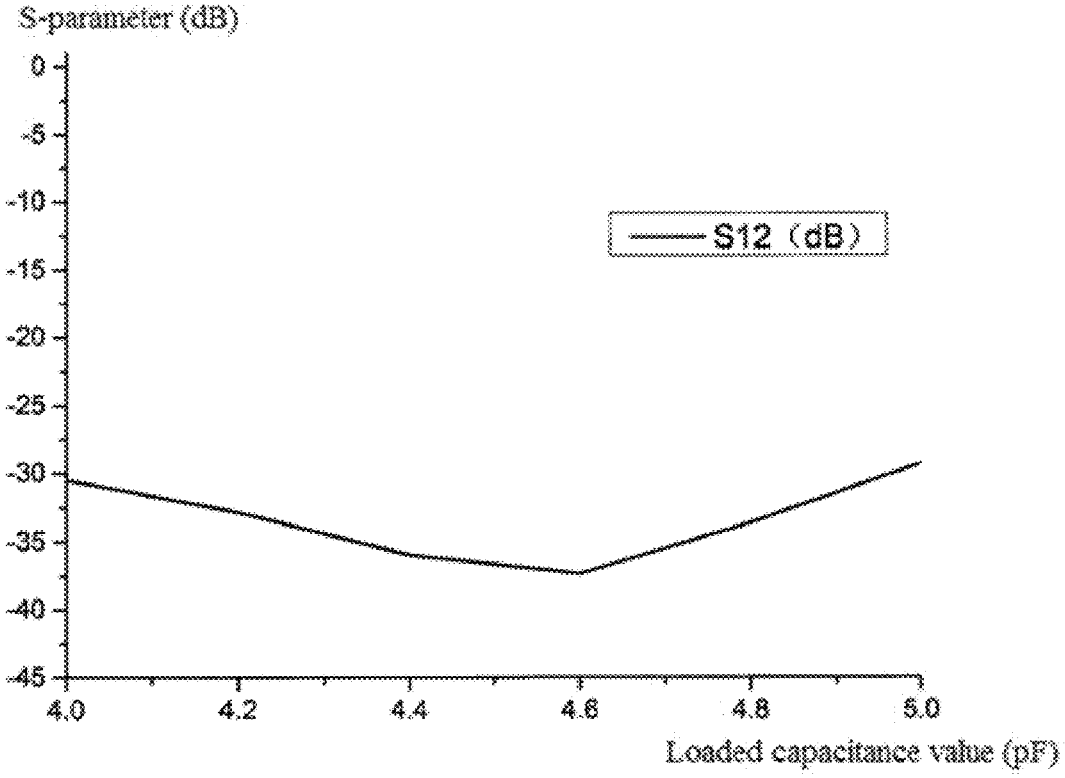
FIG. 5 is an S12 parameter diagram of the slot antenna with different loaded capacitances according to the first embodiment of the present invention.

FIG. 5 shows the change curve of the S12 parameter value of the slot antenna at the operating frequency of 140 MHz with the capacitance change of the loaded capacitors according to the first embodiment of the present invention. The slot antenna is obviously suppressed at a capacitance value of 4.6 pF, and at this time, the S12 parameter value of the slot antenna is optimal.

Second Embodiment

A length $a_1$ of the medium plate 1 is 175 cm, a width $b_1$ thereof is 110 cm, and a thickness thereof is generally 0.8 mm. A thickness of the copper-clad layer 2 is 0.035 mm.

A length $a_{21}$ of the A-slot 21 is 1 cm, and a width $b_{21}$ thereof is 30.7 cm.

A length $a_{22}$ of the B-slot 22 is 0.5 cm, and a width $b_{22}$ thereof is 89 cm.

A distance D between the A-slot 21 and the B-slot 22 is 76 cm.

A distance d between the A-capacitor 3 and the B-capacitor 4 is 68 cm. A capacitance of the A-capacitor 3 is 3.2 pF. A capacitance of the B-capacitor 4 is 3.2 pF.

The performance of the slot antenna according to the second embodiment is evaluated through S-parameters. In the drawings, the dotted line represents the conventional antenna, and the solid line represents the slot antenna according to the second embodiment of the present invention.

The present invention uses the S11 parameter to represent the working performance of the A-slot, which is basically unchanged at an operating frequency of 140 MHz before and after the capacitors are loaded.

The present invention uses the S12 parameter to evaluate the isolation between the A-slot and the B-slot before and after the capacitors are loaded. The coupling degree of the conventional antenna at an operating frequency of 400 MHz is −18 dB, and however, the coupling degree of the slot antenna according to the second embodiment of the present invention is reduced to −30 dB, which is decreased by 12 dB compared with the conventional antenna.

The present invention uses the S22 parameter to represent the working performance of the B-slot, which is basically unchanged at the operating frequency of 400 MHz before and after the capacitors are loaded.

The performance of the slot antenna according to the second embodiment before and after the capacitors are loaded is evaluated through a directional diagram. It can be seen from the E-plane directional diagram that the directionality of the slot antenna is better after the capacitors are loaded at the operating frequency of 140 MHz and is closer to the directionality of the dipole antenna. Also, it can be seen from the H-plane directional diagram that the radiation performance of the slot antenna at the H-plane is not affected when the operating frequency is 140 MHz.

Through the change curve of the mutual coupling value of the slot antenna at the operating frequency of 400 MHz with the capacitance change of the loaded capacitors according to the second embodiment of the present invention, it can be seen that the slot antenna is obviously suppressed at a capacitance value of 3.2 pF, and at this time, the S12 parameter of the slot antenna is optimal.

What is claimed is:

1. A narrow band slot antenna with a coupling suppression, which comprises: a medium plate (1), a copper-clad layer (2), an A-capacitor (3), and a B-capacitor (4), wherein:

the copper-clad layer (2) is printed on the medium plate (1) during antenna fabrication, the copper-clad layer (2) has an A-slot (21) and a B-slot (22) thereon, the A-capacitor (3) and the B-capacitor (4) are respectively mounted inside and at two ends of the B-slot (22), the B-slot (22) is configured to provide service to one wireless transceiver and the A-slot (21) is configured to provide service to another wireless transceiver that operates at a frequency different from the one wireless transceiver;

a size of the slot antenna is constrained in accordance with a condition that a wavelength λ of the slot antenna is in a range of 50 mm to 5000 mm;

the size of the slot antenna is:

$$a_1=(0.8-1.5)\lambda, b_1=(0.6-1.0)\lambda;$$

$$d=0.76\ b_{22};$$

$$D=(0.3-0.5)\lambda;$$

$$a_{21}=(0.005-0.01)\lambda, b_{21}=(0.2-0.3)\lambda;$$

$$a_{22}=(0.005-0.01)\lambda, b_{22}=(0.4-0.6)\lambda,$$

here, $a_1$ is a length of the medium plate (1), $b_1$ is a width of the medium plate (1), $a_{21}$ is a length of the A-slot (21), $b_{21}$ is a width of the A-slot (21), $a_{22}$ is a length of the B-slot (22), $b_{22}$ is a width of the B-slot (22), d is a distance between the A-capacitor (3) and the B-capacitor (4), D is a distance between the A-slot (21) and the B-slot (22).

2. The narrow band slot antenna with the coupling suppression, as recited in claim 1, wherein a loaded capacitance of each of the A-capacitor (3) and the B-capacitor (4) of the slot antenna is in a range of 0.2 pF-20 pF.

3. The narrow band slot antenna with the coupling suppression, as recited in claim 1, wherein a thickness of the copper-clad layer (2) is in a range of 0.018 mm-0.035 mm.

* * * * *